US010729970B1

(12) United States Patent
Yenidogan

(10) Patent No.: US 10,729,970 B1
(45) Date of Patent: Aug. 4, 2020

(54) OXO GAME

(71) Applicant: Liman LLC, Pleasanton, CA (US)

(72) Inventor: Deniz Yenidogan, Istanbul (TR)

(73) Assignee: Liman LLC, Pleasanton, CA (US)

( * ) Notice: Subject to any disclaimer, the term of this patent is extended or adjusted under 35 U.S.C. 154(b) by 0 days.

(21) Appl. No.: 16/352,690

(22) Filed: Mar. 13, 2019

Related U.S. Application Data

(60) Provisional application No. 62/642,518, filed on Mar. 13, 2018.

(51) Int. Cl.
*A63F 9/24* (2006.01)
*A63F 3/00* (2006.01)

(52) U.S. Cl.
CPC ..... *A63F 3/00094* (2013.01); *A63F 9/24* (2013.01); *A63F 2009/2451* (2013.01)

(58) Field of Classification Search
USPC ..... 273/271
See application file for complete search history.

(56) References Cited

U.S. PATENT DOCUMENTS 802,488 A * 10/1925 Babbit ..... A63F 9/30 273/273
2,801,107 A * 7/1957 Greer, Jr. ..... A63F 3/00094 273/241
3,556,526 A * 1/1971 Currie ..... A63F 3/00094 273/239
3,599,977 A * 8/1971 Glass ..... A63F 3/00094 273/388
3,606,333 A * 9/1971 Green ..... A63F 3/00094 273/239
3,690,664 A * 9/1972 Hauke ..... A63F 9/0204 273/127 D
3,749,401 A * 7/1973 Hayko ..... A63F 9/0204 273/389
3,770,273 A * 11/1973 Reiner ..... A63F 9/0073 273/333
3,807,738 A * 4/1974 Breslow ..... A63F 9/02 273/126 R
3,827,692 A * 8/1974 Morrison ..... A63F 7/068 273/108.56

(Continued)

*Primary Examiner* — John E Simms, Jr.
*Assistant Examiner* — Dolores R Collins
(74) *Attorney, Agent, or Firm* — Adibi IP Group, PC; Amir V. Adibi; Andrew C. Palmer

(57) ABSTRACT

A gaming device includes a base member and a plurality of components. The base member has an upper surface and a bottom surface. A first pair of components is disposed within a first gaming area of the base member and a second pair of components is disposed within a second gaming area of the base member. Each of the components is in one of two selectable states that are toggled by pressing down on the components. Each component has a gaming type characteristic and either surrounds or is surrounded by another component. The gaming device is highly portable as no additional components are needed for game play. The gaming device does not include any electrical components and component states are toggled through entirely mechanical means. In one example, the gaming device provides a tic-tac-toe gaming area where the gaming type characteristics are either an "O" shape or an "X" shape.

20 Claims, 14 Drawing Sheets

PERSPECTIVE VIEW OF A GAMING DEVICE

PERSPECTIVE VIEW OF A CLICK MECHANISM (CAM, SPRING, PIN, AND LOWER BARREL)

(56) References Cited

U.S. PATENT DOCUMENTS 3,854,725 A * 12/1974 Cluck ..... A63F 3/00643 273/238
3,879,040 A * 4/1975 Smith ..... A63F 3/00094 273/241
4,131,282 A * 12/1978 Boyer ..... A63F 3/00 273/271
4,147,361 A * 4/1979 Imatt ..... A63F 3/00094 273/271
4,149,727 A * 4/1979 Penney ..... A63F 3/00 273/271
4,275,442 A * 6/1981 Underwood ..... A63F 3/00643 273/237
4,497,491 A * 2/1985 Holman ..... A63F 3/00094 273/271
4,524,967 A * 6/1985 Hanson ..... A63F 9/30 273/273
4,684,136 A * 8/1987 Turner ..... A63F 9/18 273/146
4,813,681 A * 3/1989 Volpert, Jr. ..... A63F 3/00094 273/271
4,863,172 A * 9/1989 Rosenwinkel ..... A63F 9/0857 273/153 S
4,890,845 A * 1/1990 Gatewood ..... A63F 3/00094 273/143 E
5,413,352 A * 5/1995 Persidsky ..... A63F 3/00694 273/239
5,655,773 A * 8/1997 Marks ..... A63F 3/00094 273/264
5,657,995 A * 8/1997 Howard ..... A63F 9/305 273/333
5,839,976 A * 11/1998 Darr ..... A63B 5/22 473/414
5,927,714 A * 7/1999 Kaplan ..... G07F 17/34 273/143 R
6,170,824 B1 * 1/2001 Kaplan ..... A63F 3/00 273/236
6,572,469 B2 * 6/2003 Klitsner ..... A63F 3/00094 273/271
7,604,539 B2 * 10/2009 Hartl ..... G07F 17/32 463/16
7,832,729 B2 * 11/2010 Park ..... A63F 3/00214 273/241
8,210,537 B1 * 7/2012 Ladhe ..... A63F 3/00094 273/271
8,505,918 B1 * 8/2013 Appelblatt ..... A63F 3/00094 273/271
8,523,647 B2 * 9/2013 McClintic ..... G07F 17/32 463/10
9,039,011 B2 * 5/2015 Van Ness ..... A63F 3/00214 273/261
10,099,112 B1 * 10/2018 Johnson ..... A63F 3/00214
2005/0054423 A1 * 3/2005 Wadleigh ..... G07F 17/32 463/20
2006/0232007 A1 * 10/2006 Kuehn ..... A63F 3/0023 273/239
2008/0157476 A1 * 7/2008 Striebel ..... A63B 63/00 273/402
2012/0292854 A1 * 11/2012 Hamermesh ..... A63H 1/24 273/288
2016/0236071 A1 * 8/2016 Rabin ..... A63F 3/00261

* cited by examiner

PERSPECTIVE VIEW OF A GAMING DEVICE

PERSPECTIVE VIEW OF A CLICK MECHANISM
(CAM, SPRING, PIN, AND LOWER BARREL)

PERSPECTIVE VIEWS OF A CAM AND A LOWER BARREL IN A SPRING-LOADED RETRACTABLE CLICK MECHANISM

PERSPECTIVE VIEW OF TEETH OF AN UPPER BARREL SLIDING AGAINST TEETH FROM A CAM

TOP VIEW OF THE GAMING DEVICE

DIFFERENT VIEWS OF THE GAMING DEVICE COMPONENTS

BOTTOM PERSPECTIVE VIEW OF THE GAMING DEVICE

FORMING A GAMING DEVICE

PACKAGED GAMING DEVICE

GAMING DEVICE WITH GLOW MATERIAL
(ALTERNATE EMBODIMENT)

GAMING DEVICE WITH AUDITORY INDICATOR (SPEAKER)
(ALTERNATE EMBODIMENT)

GAMING DEVICE WITH VISUAL INDICATOR (LIGHT SOURCE)
(ALTERNATE EMBODIMENT)

SIDE VIEW OF GAMING DEVICE WITH INDENTED HOOK MECHANISM (ALTERNATE EMBODIMENT)

SIDE VIEW OF GAMING DEVICE WITH PROTRUDING HOOK MECHANISM (ALTERNATE EMBODIMENT)

GAMING DEVICE KEYCHAIN (ALTERNATE EMBODIMENT)

OXO GAME

CROSS-REFERENCE TO RELATED APPLICATION

This application claims the benefit under 35 U.S.C. § 119 of provisional application Ser. No. 62/642,518, entitled "OXO Game", filed Mar. 13, 2018. The entirety of provisional application Ser. No. 62/642,518 is incorporated herein by reference.

TECHNICAL FIELD

The described embodiments relate to devices usable to play the tic-tac-toe game, and to related methods.

BACKGROUND INFORMATION

Tic-Tac-Toe (also known as "noughts and crosses") is a familiar Paper and pencil game that is popular the world over. It is played by two players. The players draw a three-by-three grid. The players then take turns placing their respective marks in the positions of the grid. One player places "O" marks. The other player places "X" marks. The player who first succeeds in placing three of his/her marks in a horizontal, vertical, or diagonal row wins the game.

SUMMARY

A gaming device includes a base member and a plurality of components. The base member has an upper surface and a bottom surface. A first pair of components is disposed within a first gaming area of the base member and a second pair of components is disposed within a second gaming area of the base member. Each of the components is in one of two selectable states that are toggled by pressing down on the components.

The gaming device provides a gaming area in which the components are toggled between states during game play. Each component has a gaming type characteristic that is used to associated components with each player. The gaming type characteristic varies depending on the gaming device that is provided. In the case of tic-tac-toe, a first player has components having the gaming type characteristic of an "O" shape and a second player has components having the gaming type characteristic of an "X" shape. Each component either surrounds another component or is surrounded by another component.

The gaming device is highly portable as no additional components are needed for game play. The gaming device does not include any electrical components and component states are toggled through entirely mechanical means.

The foregoing is a summary and thus contains, by necessity, simplifications, generalizations and omissions of detail; consequently it is appreciated that the summary is illustrative only. Still other methods, and structures and details are set forth in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Reference will now be made in detail to some embodiments of the invention, examples of which are illustrated in the accompanying drawings.

Figure 1:
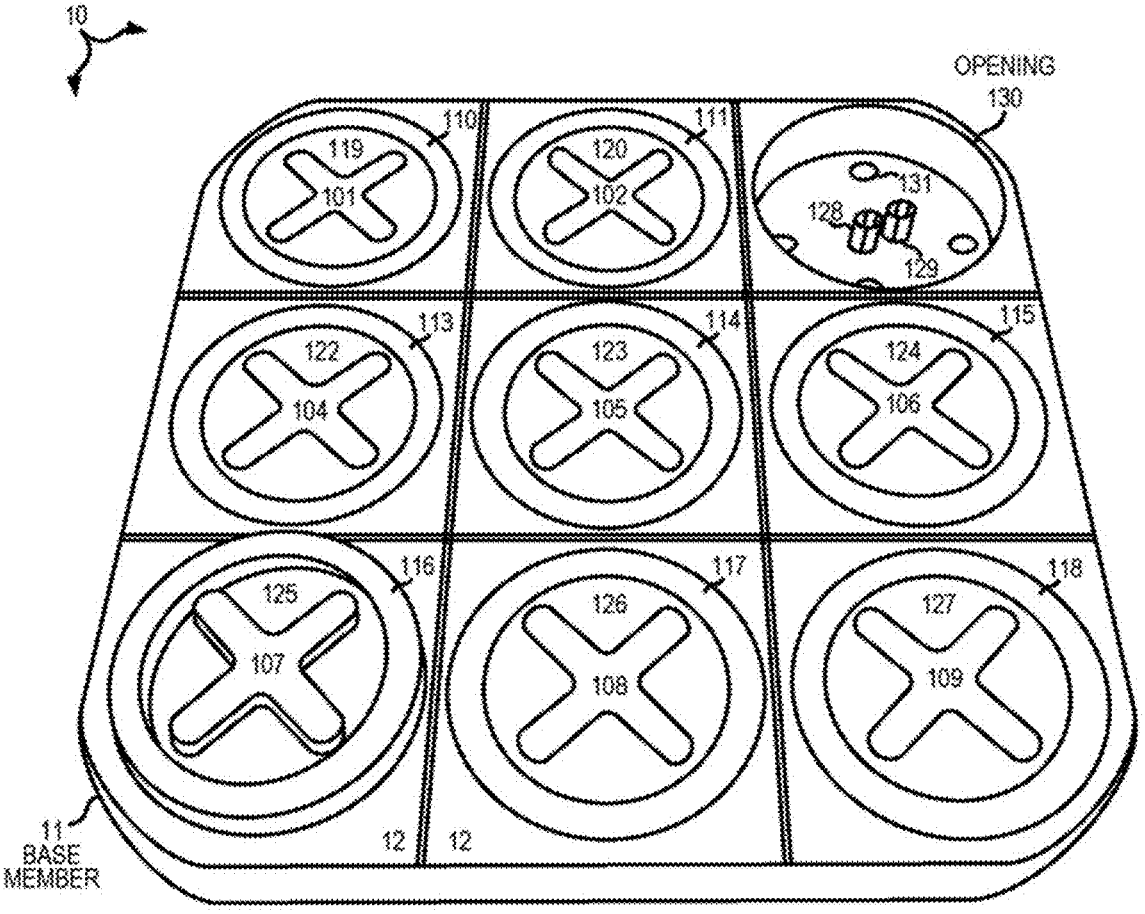
FIG. 1 shows a perspective view of the novel tic-tac-toe game apparatus 10.

FIG. 1 shows a top perspective view of a novel tic-tac-toe game apparatus 10, referred to here as the "OXO Game". The game apparatus 10 includes a base member 11, nine X-shaped pop-up elements 101-109, nine O-shaped pop-up elements 110-118, nine circular-shaped elements 119-127, and eighteen spring-loaded retractable click mechanisms. Only two of the spring-loaded retractable click mechanisms are seen from the perspective of FIG. 1. The X-shaped pop-up element 103, the O-shaped pop-up element 112, and the circular-shaped element 121 have been removed in the illustration of FIG. 1 so that the spring-loaded retractable click mechanisms 128 and 129 are revealed. Spring-loaded retractable click mechanism 128 is the click mechanism for X-shaped pop-up element 103. Spring-loaded retractable click mechanism 129 is the click mechanism for O-shaped pop-up element 112. There is at least one spring-loaded retractable click mechanism for each of the pop-up elements.

The base member 11 has a thickness that is at least as thick as the height of one of the pop-up elements. The upper surface 12 of the base member 11 is substantially planar and extends in a plane, referred to here as the "base member plane". There are nine shallow cylindrical openings that extend downward into the base member 11 from the upper surface 12. Reference numeral 130 identifies one of these shallow cylindrical openings. In each of these shallow cylindrical openings is disposed a corresponding O-shaped pop-up element and a corresponding X-shaped pop-up element. Each pop-up element can be in a pressed-down state or can be disposed in a popped-up state.

When a pop-up element is in its pressed-down state, then the body of the pop-up element is either entirely or substantially disposed below the base member plane of the upper surface of the base member. The upper surface of the pop-up element is planar. In this state, the upper surface of the pop-up element is in the plane of the base member plane of the upper surface of the base member.

When a pop-up element is in its popped-up state, then the body of the pop-up element extends upward with respect to the base member so that more of pop-up element protrudes above the base member plane of the base member as compared to how much of the pop-up element protrudes above the base member plane when the pop-up element is in the pressed-down state.

Each of the O-shaped pop-up elements can be in its pressed-down state, or can be in its popped-up state. For example, O-shaped pop-up element 117 is shown in its pressed-down state, whereas O-shaped pop-up element 116 is shown in its popped-up state. Likewise, each of the X-shaped pop-up elements can be in its pressed-down state, or can be in its popped-up state. For example, X-shaped pop-up element 108 is shown in its pressed-down state, whereas X-shaped pop-up element 107 is shown in its popped-up state.

A user can cause a pop-up element to toggle between its pressed-down state and its popped-up state by pressing down and then releasing the pop-up element. Each time the pop-up element is pressed down and released, its final resting position changes state. If the prior state of the pop-up element was the pressed-down state, then a pressing and releasing of the pop-up element causes the pop-up element to move to the popped-up state. Similarly, if the prior state of the pop-up element was the popped-up state, then a pressing and releasing of the pop-up element causes the pop-up element to move to the pressed-down state.

Unlike the O-shaped and X-shaped pop-up elements, each of the circular-shaped elements 119-127 remain on the same plane as the base member plane and cannot be popped-up or pressed-down. The circular-shaped elements help maintain vertical alignment of the O-shaped and X-shaped pop-up elements when sliding up and down with respect to the base member 11.

Figure 2:
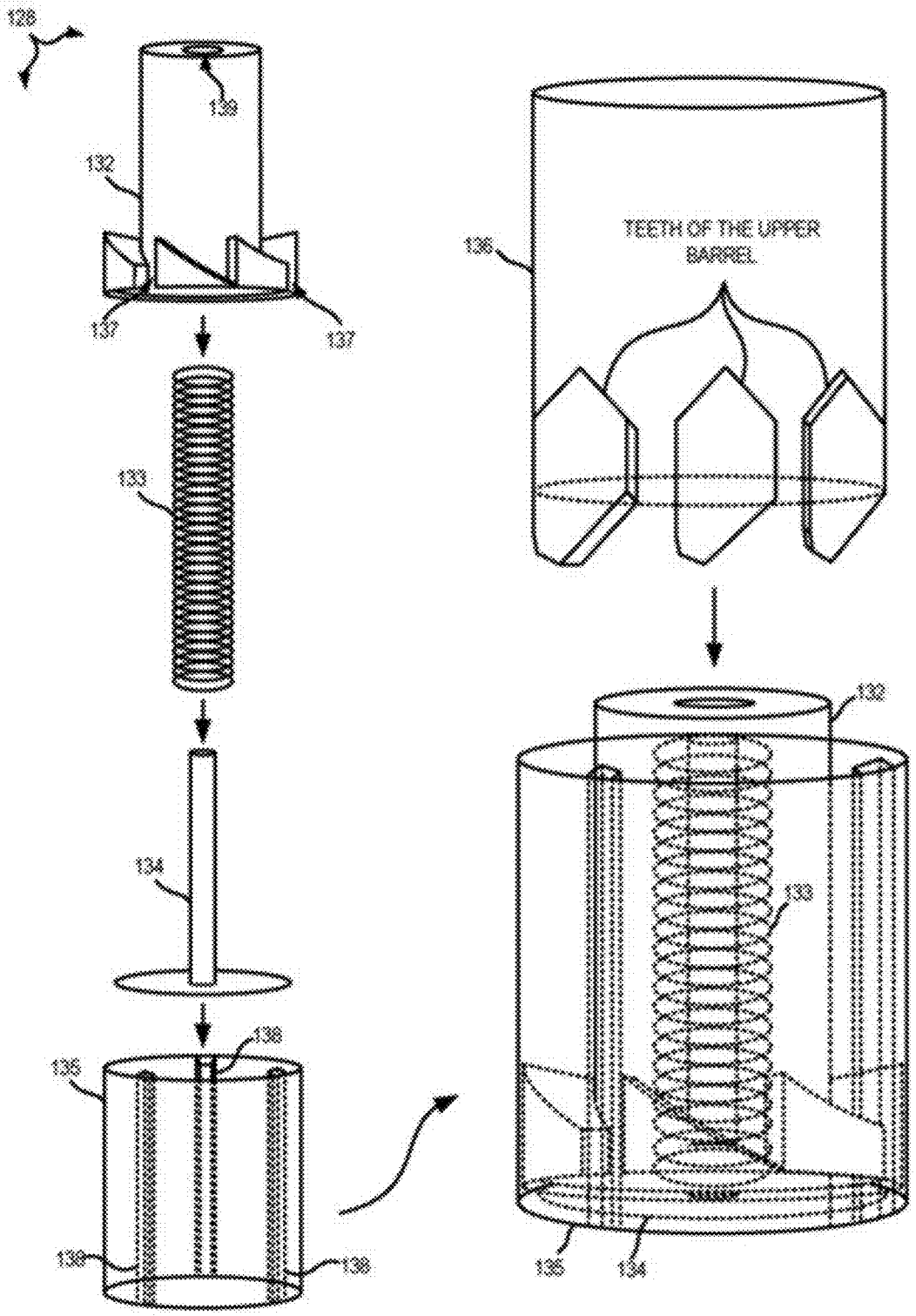
FIG. 2 shows an exploded view of one of the spring-loaded retractable click mechanisms.

FIG. 2 shows a perspective view of one of the spring-loaded retractable click mechanisms 128 (used with the O-shaped pop-up elements). The spring-loaded retractable click mechanism 128 comprises a cam 132, a spring 133, a pin 134, a lower barrel 135 and an upper barrel 136. Similarly, the spring-loaded retractable click mechanism 129 (not shown) is used with the X-shaped pop-up elements.

Figure 3:
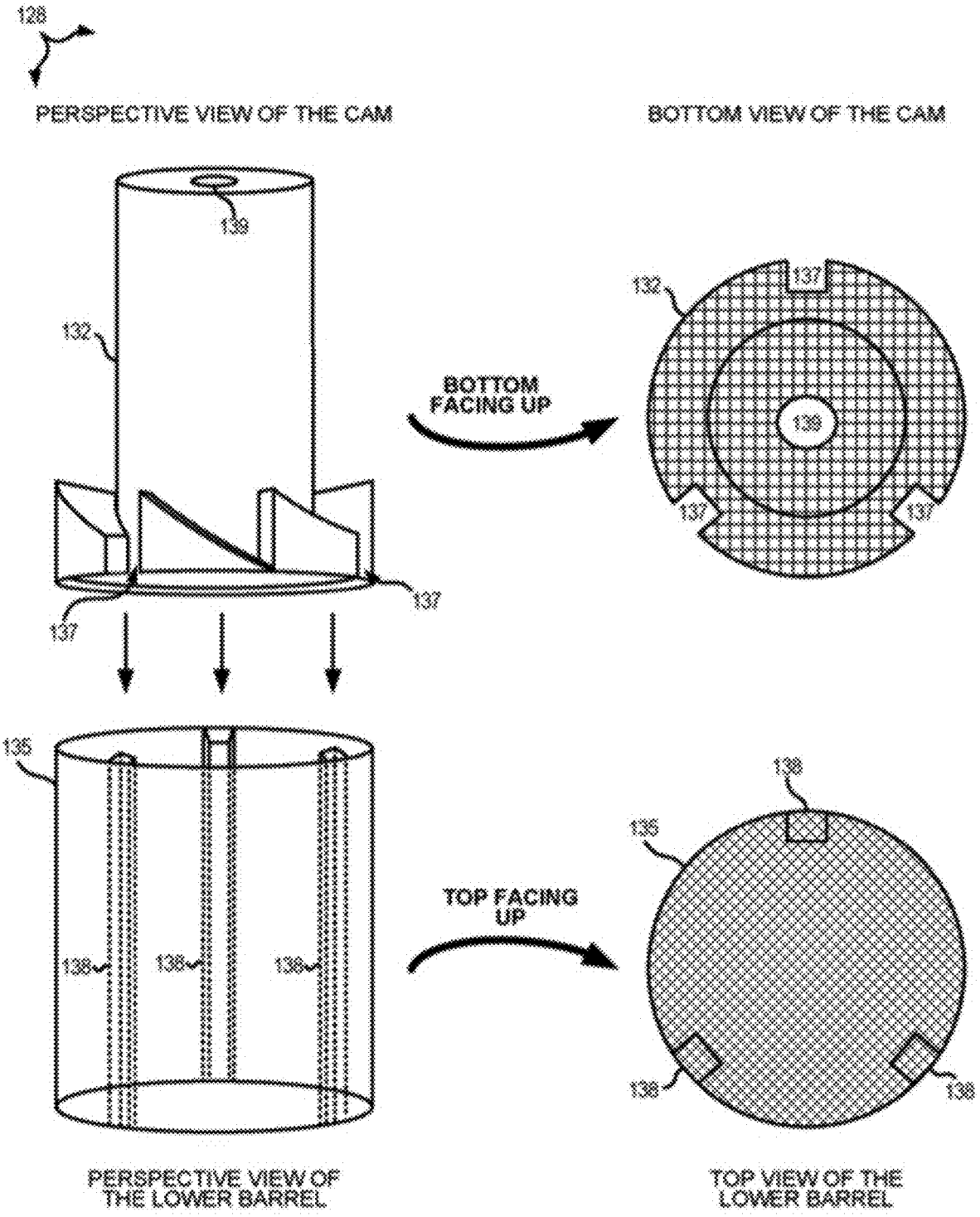
FIG. 3 is another diagram that shows how parts of the spring-loaded retractable click mechanism of FIG. 2 slide together.
Figure 4:
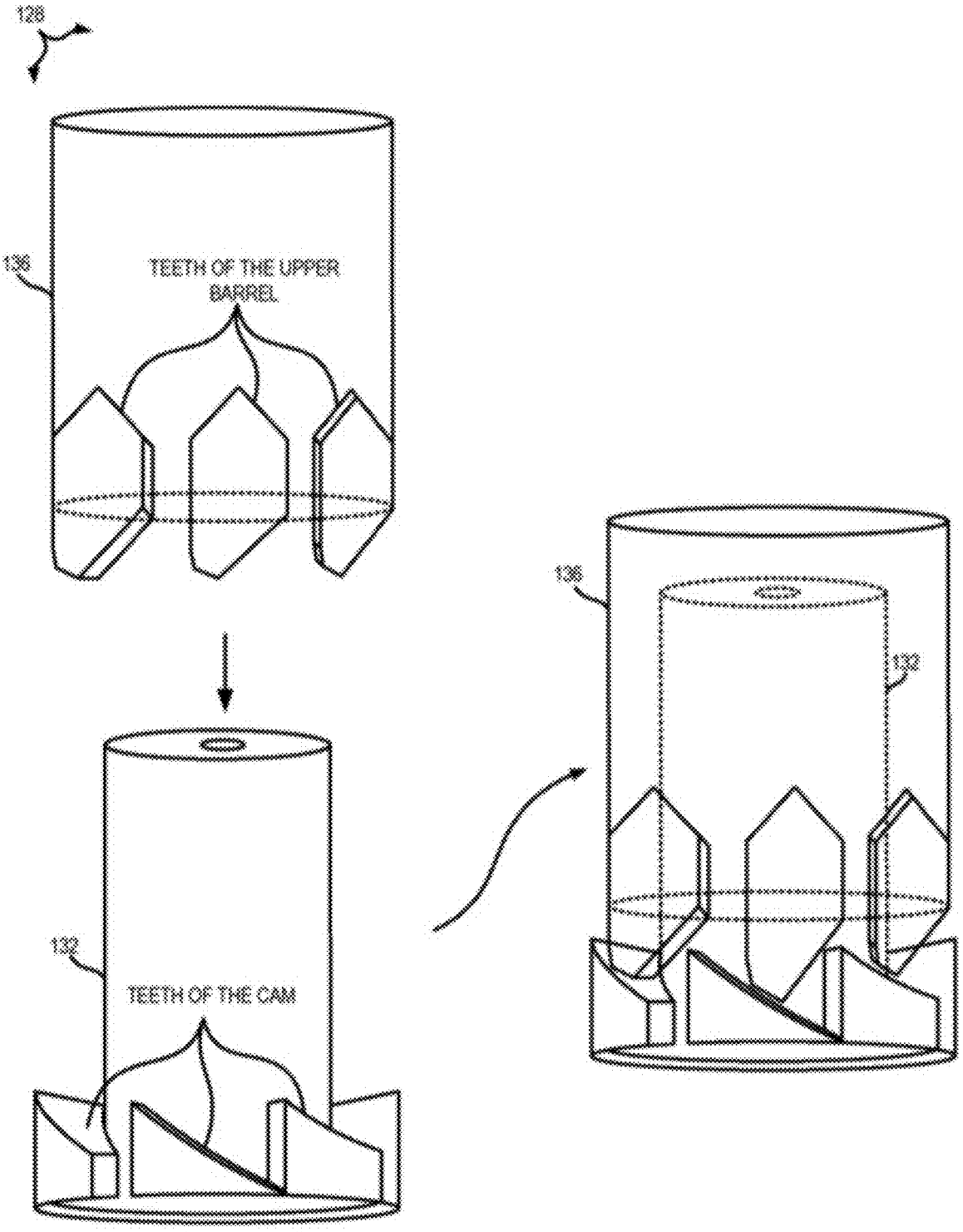
FIG. 4 is another diagram that shows how teeth on the cam engage corresponding teeth on the upper barrel.

The cam 132 has a cylindrical shape with teeth along the bottom that engage with the teeth located on the upper barrel 136 (see FIG. 4). The cam 132 also has a plurality of notches 137 that have a cross-sectional area that is substantially similar to the cross-sectional area of a plurality of slide guides 138 of the lower barrel 135 (see FIG. 3). This is to allow the cam 132 to slide along the vertical axis of the lower barrel 135 while still being able to engage the teeth of the upper barrel 136 (see FIG. 4). On the upper end of the cam 132 is a hole 139 having a diameter that is larger than the diameter of the upper end of the pin 134 but smaller than the diameter of the spring 133. This is to allow the cam 132 to compress the spring 133 while also being aligned along the pin 134.

The spring 133 in its expanded form has a length greater than the height of the cam 132, pin 134, and lower barrel 135. The spring 133 is placed inside the interior of the cam 132. Next, the spring 133 is placed on top of the pin 134. The diameter of the upper end of the pin 134 is smaller than the diameter of the spring 133. The diameter of the lower end of the pin 134 is larger than the diameter of the spring 133. Then, the cam 132, the spring 133, and the pin 134 slide into the lower barrel 135. The bottom of the lower barrel 135 is connected to the base member 11 in the bottom of the opening 130 (see FIG. 1).

Once the cam 132, the spring 133, and the pin 134 have been slid into the lower barrel 135, the upper barrel 136 is slid into the lower barrel 135. The teeth of the upper barrel 136 engage with the teeth of the cam 124 resulting in an extended position and a retracted position of the click mechanism 119.

In the example shown in FIG. 1, the click mechanism of the X-shaped pop-up element 107 in its extended position. The X-shaped pop-up element 107 protrudes above the plane of the upper surface 12 of the base member 11. In the example shown in FIG. 1, the click mechanism of the X-shaped pop-up element 108 is in its retracted position. The X-shaped pop-up element 108 does not extend above the plane of the upper surface of the base member 11 but rather the planar upper surface of the X-shaped pop-up element 108 is in the plane of the upper surface 12 of the base member 11.

FIG. 3 is another diagram of the cam 132 and the lower barrel 135. The cam 132 has a plurality of notches 137 that have a cross-sectional area that is substantially similar to the cross-sectional area of a plurality of slide guides 138 of the lower barrel 135. The plurality slide guides 138 significantly limit the cam 132 from rotating on along the horizontal axis. The lower barrel 135 can be part of the spring-loaded click mechanism 128 or 129. In yet another example, there are more or less slide guides 138 with different shapes that are substantially similar to the notches 137 on the cam 132.

FIG. 4 shows a perspective view of teeth from an upper barrel sliding against teeth from a cam. The upper barrel 136 has teeth along its lower end. The cam 132 has teeth that face in the opposite direction of the teeth on the upper barrel 136 of the upper barrel 136 interlock with the teeth of the cam 132. This is to allow the cam 132 to translate linear motion into rotational motion.

Figure 5:
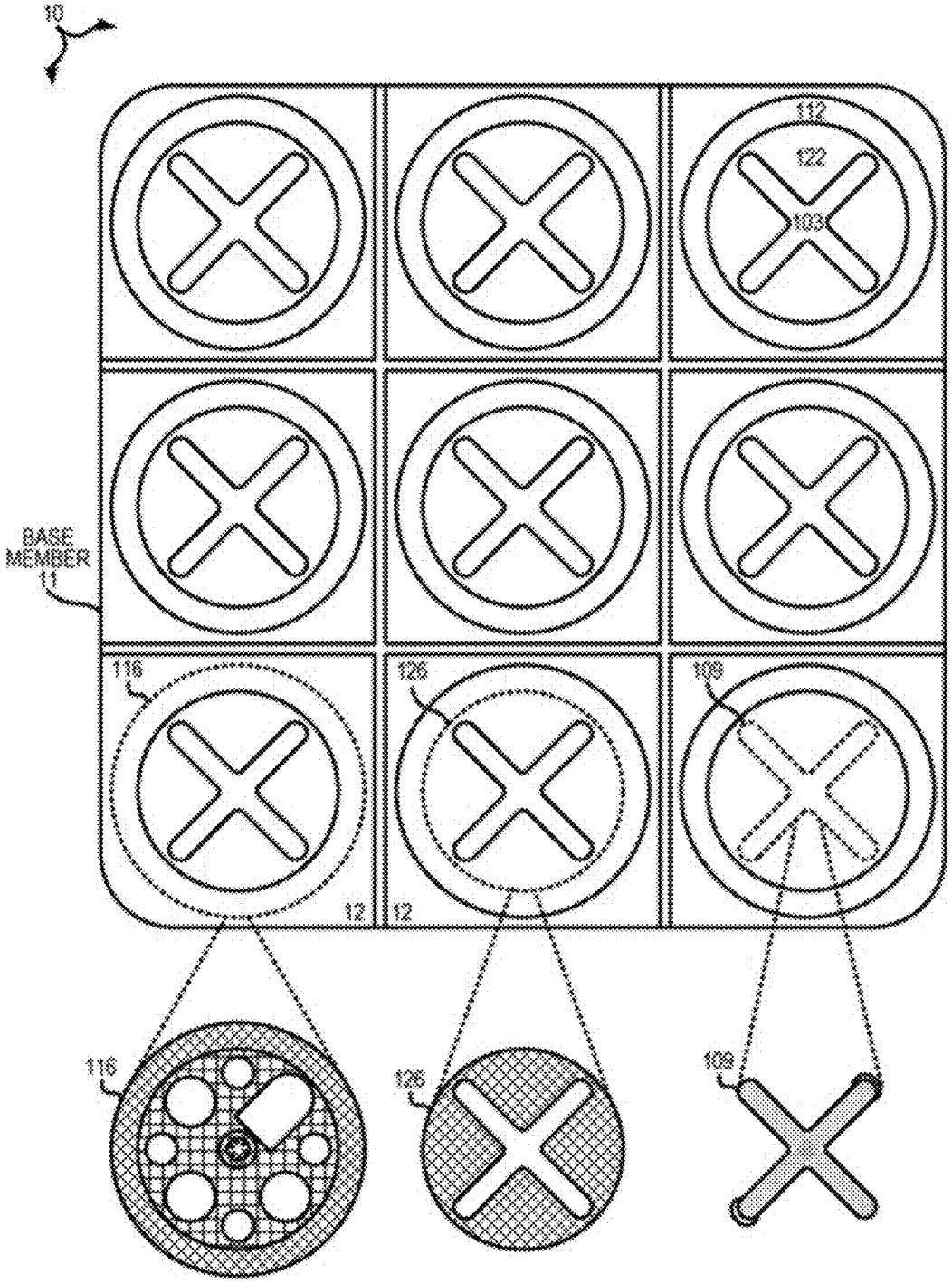
FIG. 5 shows a top perspective view of the tic-tac-toe game apparatus.

FIG. 5 shows a top perspective view of the gaming device. In this example, the O-shaped pop-up element 116 is shown from its top-perspective view. Additionally, the circular-shaped element 126 is shown from its top-perspective view. Furthermore, the X-shaped pop-up element 109 is shown from its top-perspective view.

Figure 6:
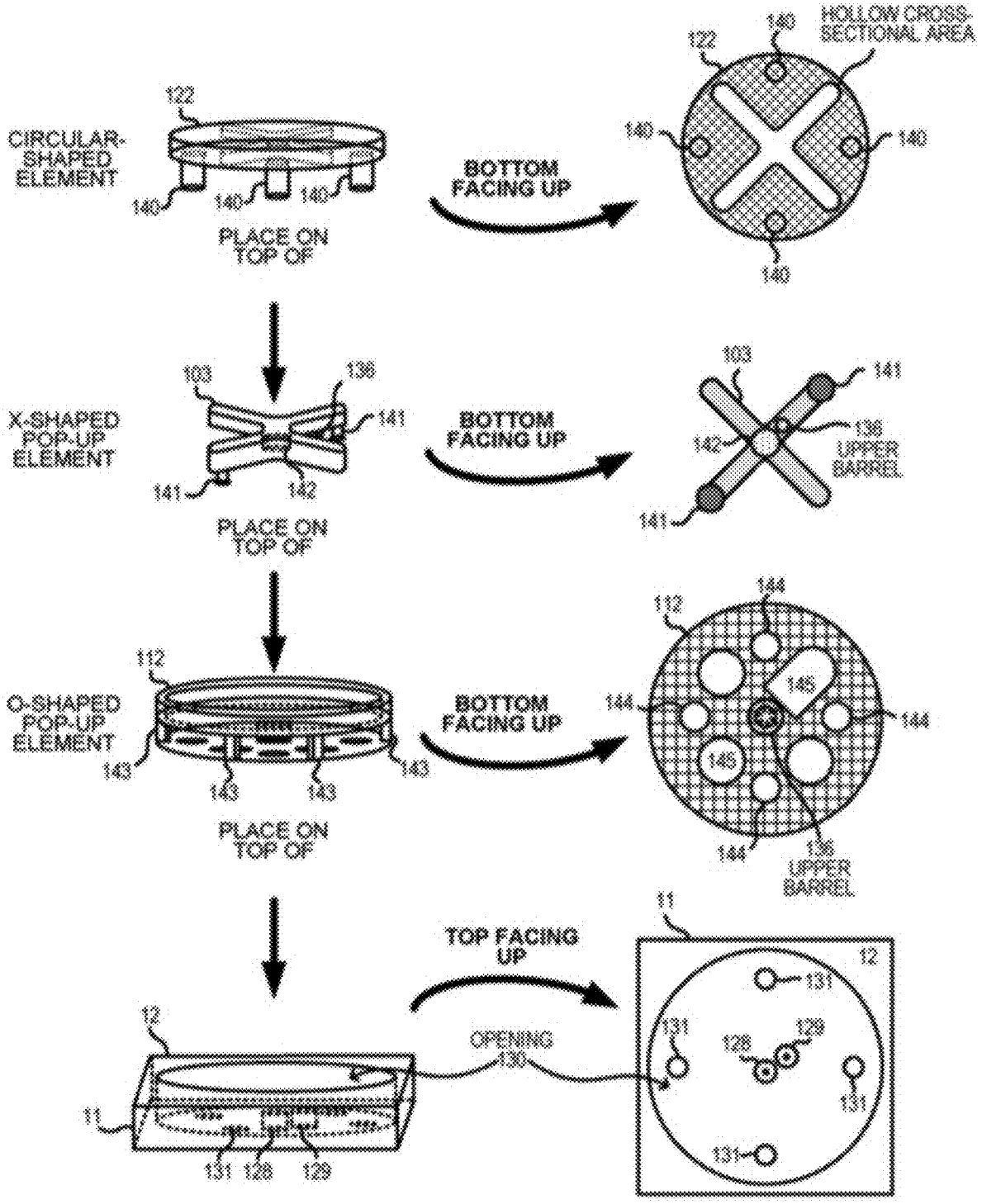
FIG. 6 shows different views of the tic-tac-toe game apparatus.

FIG. 6 shows different views of the gaming device components. The circular-shaped element 122 is placed on top of the X-shaped pop-up element 103, which is placed on the O-shaped pop-up element 112, which is then placed in the opening 130. The circular-shaped element 122 has a hollow X-shaped section similar to the shape of the X-shaped pop-up element 103.

The circular-shaped element 122 comprises the first layer. The circular-shaped element 122 has four legs 140 on its bottom surface. Each leg 140 has a height such that the circular-shaped element 122 is in the same plane as the upper surface 12 of the base member 11. The cross-sectional area of each leg 140 is smaller than the cross-sectional area of each leg hole 144 in the O-shaped pop-up element. This is to allow the legs 140 of the circular-shaped element to slide through the leg holes 144 in the O-shaped pop-up element. Each leg 140 fits into a slot 131 within the opening 130 of the base member 11. This is to prevent the circular-shaped element from rotating or moving while at the same time help maintain the vertical alignment of the X-shaped and O-shaped pop-up elements.

The second layer is the X-shaped pop-up element 103. The bottom surface of the X-shaped pop-up element has an upper barrel 136, two feet 141, and an opening 142. The feet 141 are at a height such that the X-shaped element is in the same plane as the upper surface 12 of the base member 11 when the click mechanism 128 is in the pressed-down state. The cross-sectional area of each foot 141 is wider than the hollow cross-sectional area of the circular-shaped element 122. This is to prevent the X-shaped pop-up element 103 from completely exiting through the top of the circular-shaped element 122 when in the popped-up state. The cross-sectional area of each foot 141 is smaller than the cross-sectional area of the foot holes 145 in the O-shaped pop-up element.

The upper barrel 136 on the X-shaped pop-up element is for the spring-loaded retractable click mechanism 129. The upper barrel 136 and one of the feet 141 are able to fit within the top right hole 145 of the O-shaped element. In addition, an opening 142 is located on the bottom surface of the X-shaped pop-up element 103. The opening 142 is shallow and can fit around the upper barrel 136 of the O-shaped pop-up element 112. This allows the X-shaped pop-up element to be in the same plane as the upper surface 12 of the base member 11 when in the pressed-down state.

The third layer is the O-shaped pop-up element 112. In the example shown in FIG. 6, the bottom surface of the O-shaped pop-up element 112 has a plurality of holes (e.g.—leg holes 144 and foot holes 145), an upper barrel 136, and a plurality of posts 143. The plurality of posts 143 support the upper surface of the O-shape element. There are four leg holes 144 that are lined up with the four slots 131 in the opening 130 of the base member 11. The leg holes 144 are also used to keep the legs 140 of the circular-shaped element in place.

The fourth layer is one of the nine shallow cylindrical openings 130 that extend downward into the base member 11 from the upper surface 12. Within the opening are four slots 131 that are used to keep the legs 140 of the circular-shaped element 122 in place. Within the opening 130 are two spring-loaded retractable click mechanisms 128 and 129.

Figure 7:
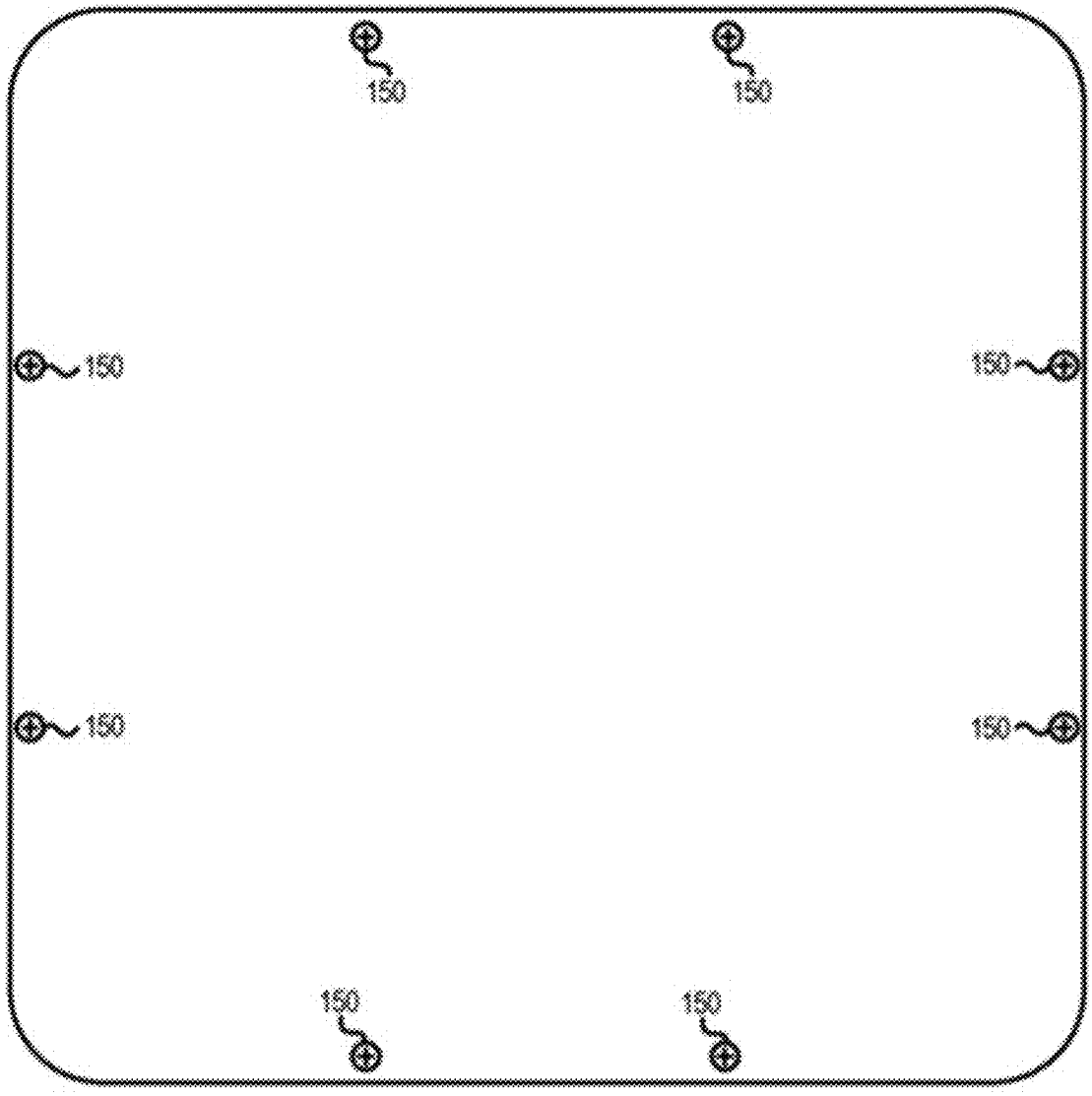
FIG. 7 is a diagram of the bottom of the tic-tac-toe game apparatus.

FIG. 7 shows a bottom perspective view of the gaming device. In this example, the gaming device uses a plurality of screws 150 along each edges of the bottom surface to secure the bottom surface to the base member 11. In another example, the gaming device uses a different number of fasteners or different types of fasteners.

Figure 8:
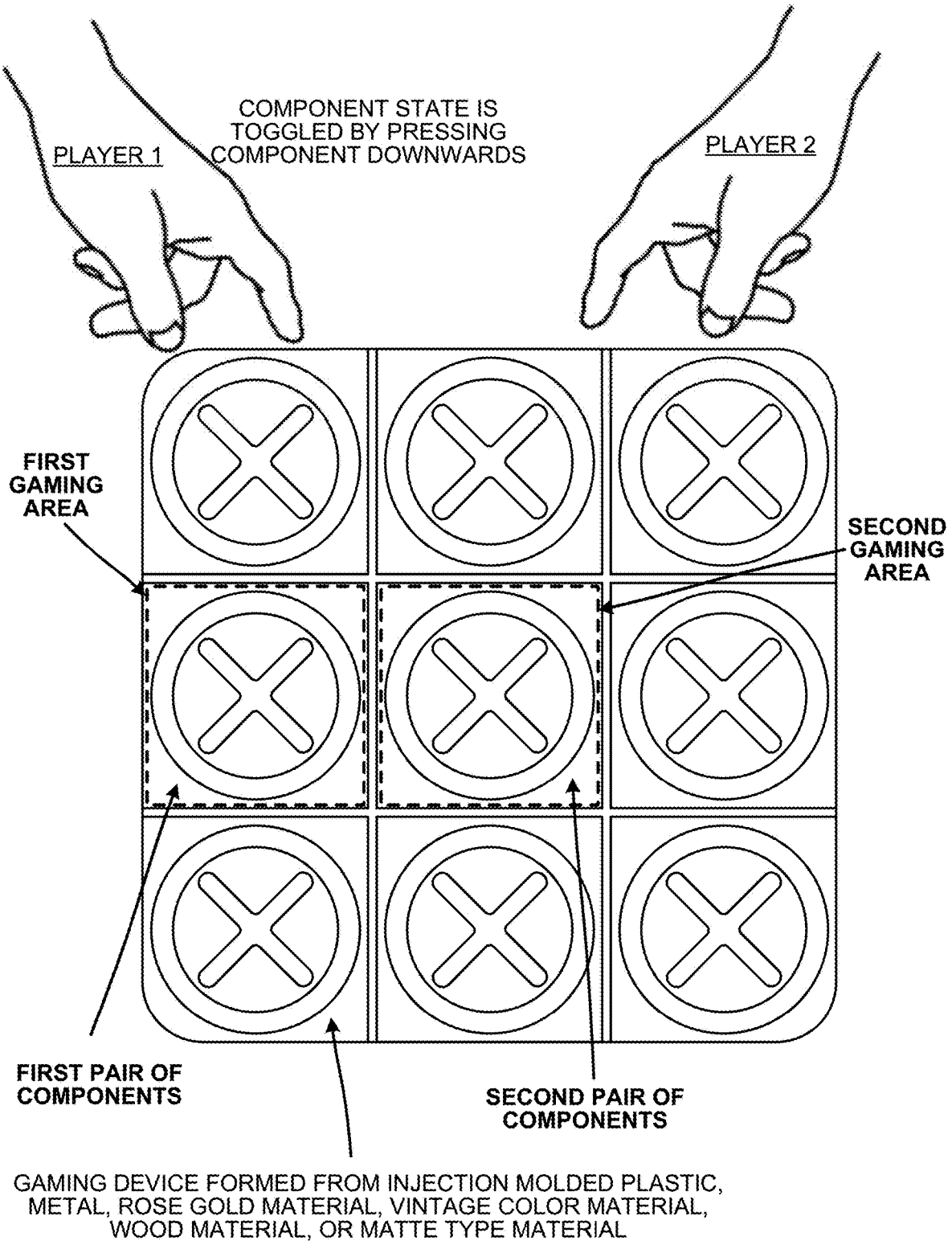
FIG. 8 is a diagram of a gaming device in accordance with one novel aspect.

FIG. 8 is a diagram of a gaming device in accordance with one novel aspect. The gaming device of FIG. 8 is substantially similar to the gaming device 10 of FIG. 1. Labels identify various inventive aspects of the gaming device. The base member includes several gaming areas, including a first gaming area and a second gaming area identified by dashed boxes. The first gaming area includes a first pair of components. The second gaming area includes a second pair of components.

The components are used during game play such that a user obtains control of one of the gaming areas by pressing down on the user's corresponding component thereby achieving a desired gaming objective. Pressing down on a component causes the component to toggle between states. In the case of the tic-tac-toe game, the gaming objective is for two players to take turns obtaining gaming areas until the winning player obtains at least three consecutive gaming areas connected in a linear fashion.

In one example, the gaming device is formed from injection molded plastic. In another example, the gaming device is formed from metal. In yet another example, the gaming device is formed from rose gold material. In yet another example, the gaming device is formed from vintage colored material. In yet another example, the gaming device is formed from wood. In still another example, the gaming device is formed from matte type material.

Figure 9:
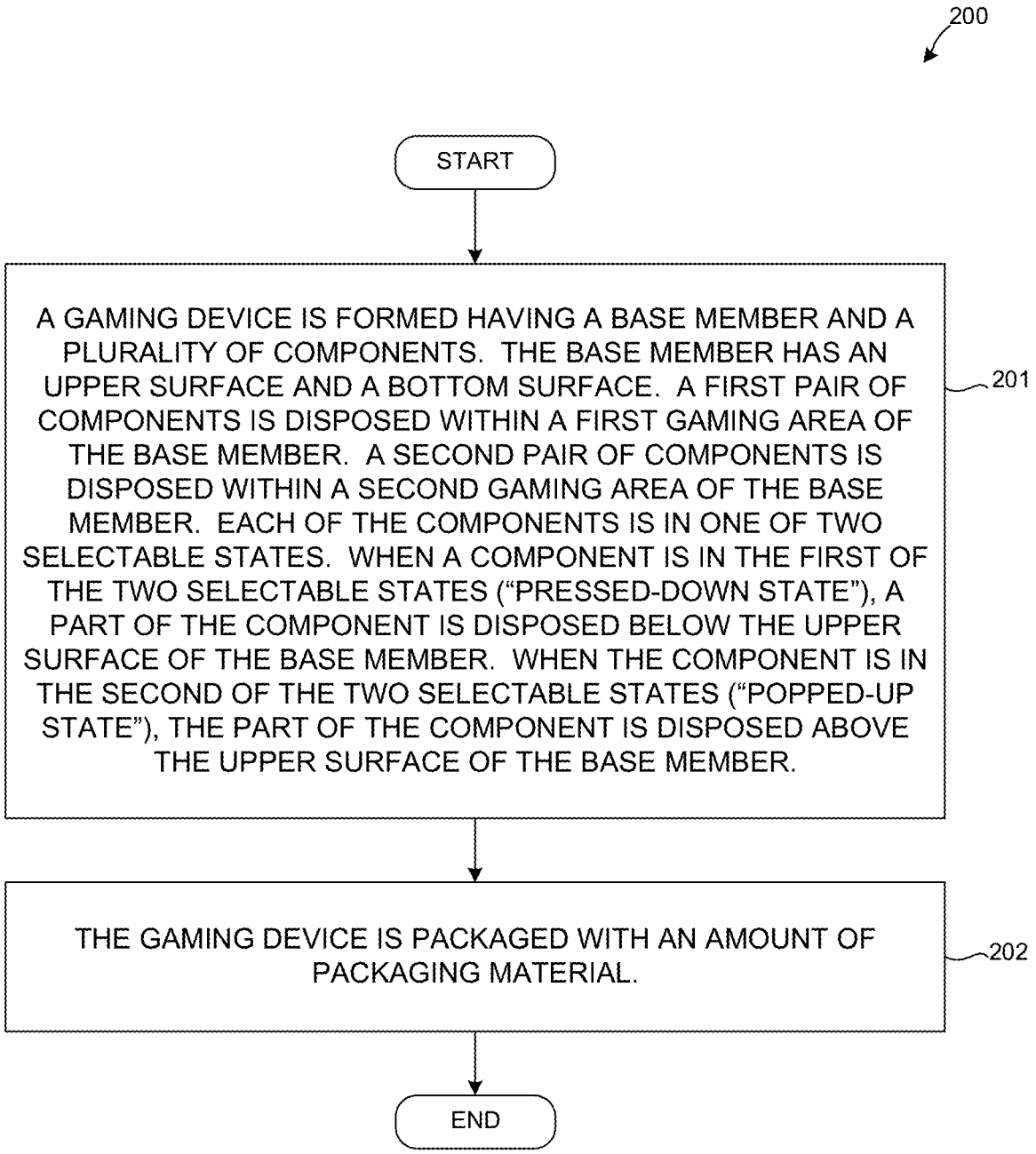
FIG. 9 a flowchart of a method 200 in accordance with one novel aspect.

FIG. 9 a flowchart of a method 200 in accordance with one novel aspect. In a first step (step 201), a gaming device is formed having a base member and a plurality of components. The base member has an upper surface and a bottom surface. A first pair of components is disposed within a first gaming area of the base member. A second pair of components is disposed within a second gaming area of the base member. Each of the components is in one of two selectable states. When a component is in the first of the two selectable states, a part of the component is disposed below the upper surface of the base member. The first selectable state is also referred to as a "pressed-down state". When the component is in the second of the two selectable states, the part of the component is disposed above the upper surface of the base member. The second selectable state is also referred to as a "popped-up state".

In a second step (step 202), the gaming device is packaged with an amount of packaging material. In one example, the gaming device is packaged along with an amount of instructions that inform a user how to use the gaming device to play a game.

Figure 10:
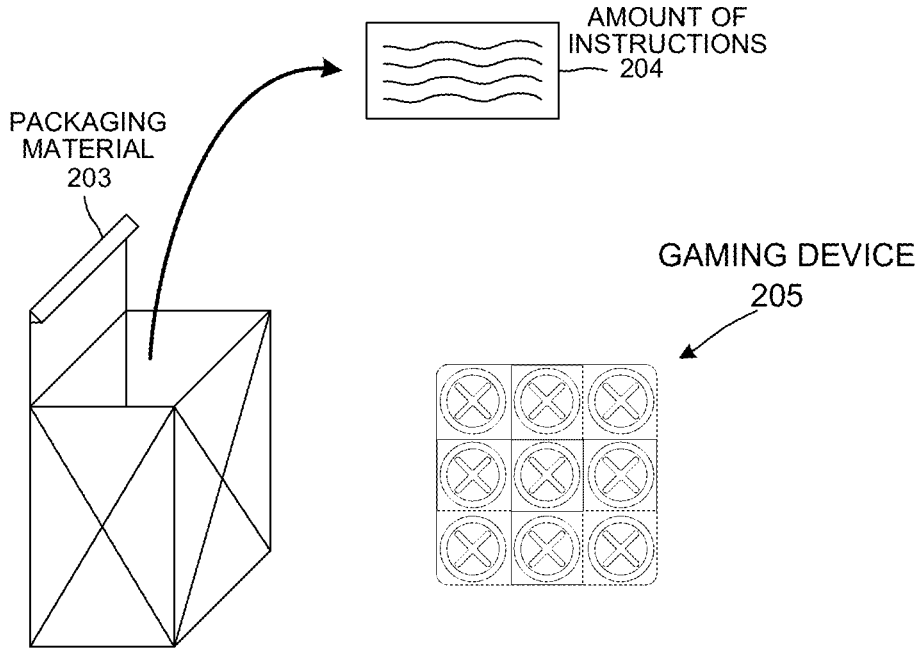
FIG. 10 is a diagram showing a packaged gaming device.

FIG. 10 is a diagram showing a packaged gaming device. Gaming device 205 is substantially similar to the gaming device 10 of FIG. 1. The gaming device 205 is packaged in packaging material 203. In this example, an amount of instructions 204 is included along with packaging material 203. The amount of instructions 204 instruct a user how to play a game using the gaming device 205. In another example, no instructions are provided along with the gaming device 205. In yet another example, an amount of visual content is provided on the packaging material that provides a link to a user for accessing gaming instructions. The visual content may be a visual code that is scannable by a mobile communication device.

Figure 11:
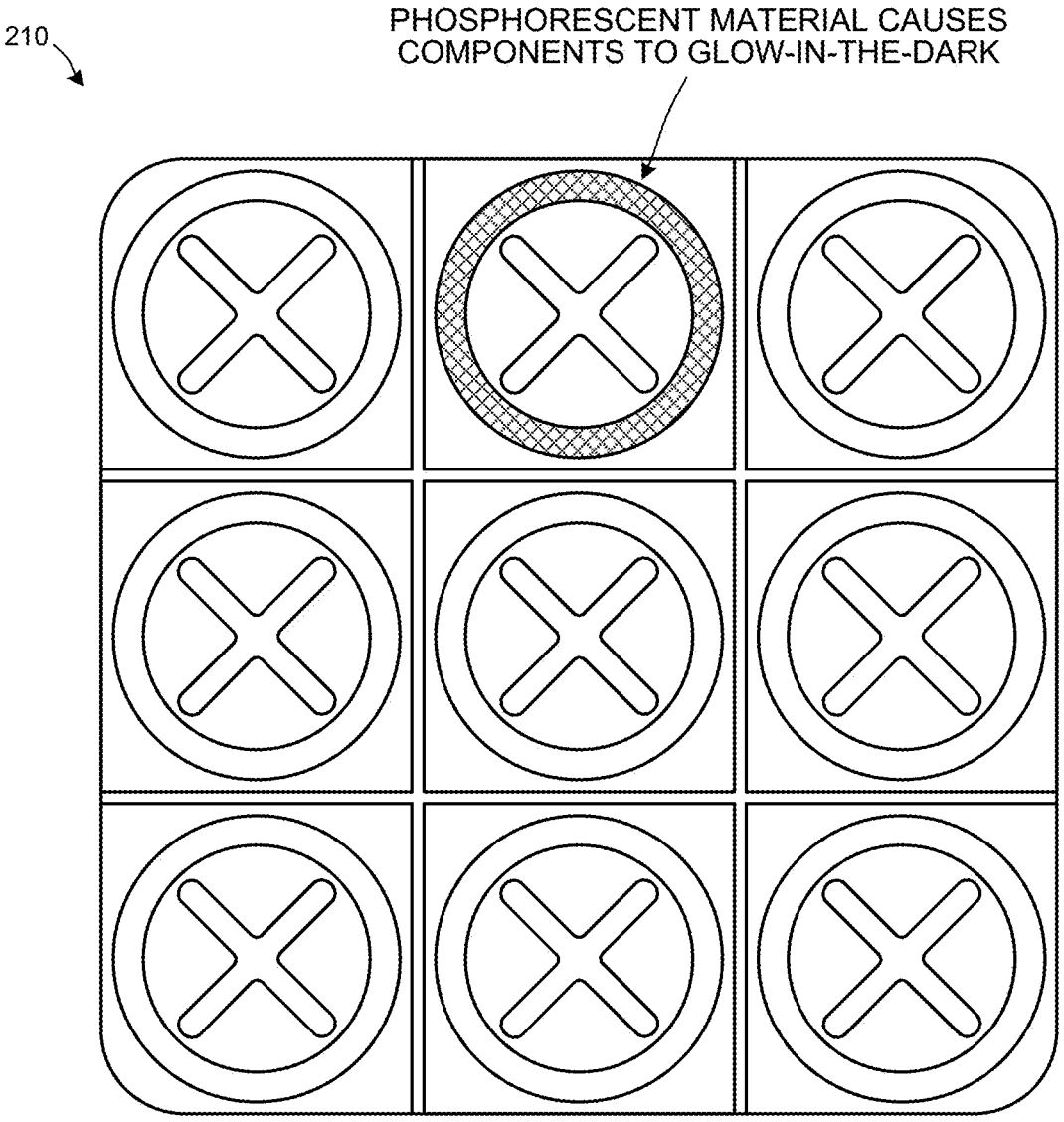
FIG. 11 is a diagram of another embodiment of a gaming device 210.

FIG. 11 is a diagram of another embodiment of a gaming device 210. Gaming device 210 is substantially similar to the gaming device 10 of FIG. 1. The gaming device 210 includes phosphorescent material that emits light in dark environment. Gaming device 210 provides the option of users playing games on the gaming device 210 in dark environments.

Figure 12:
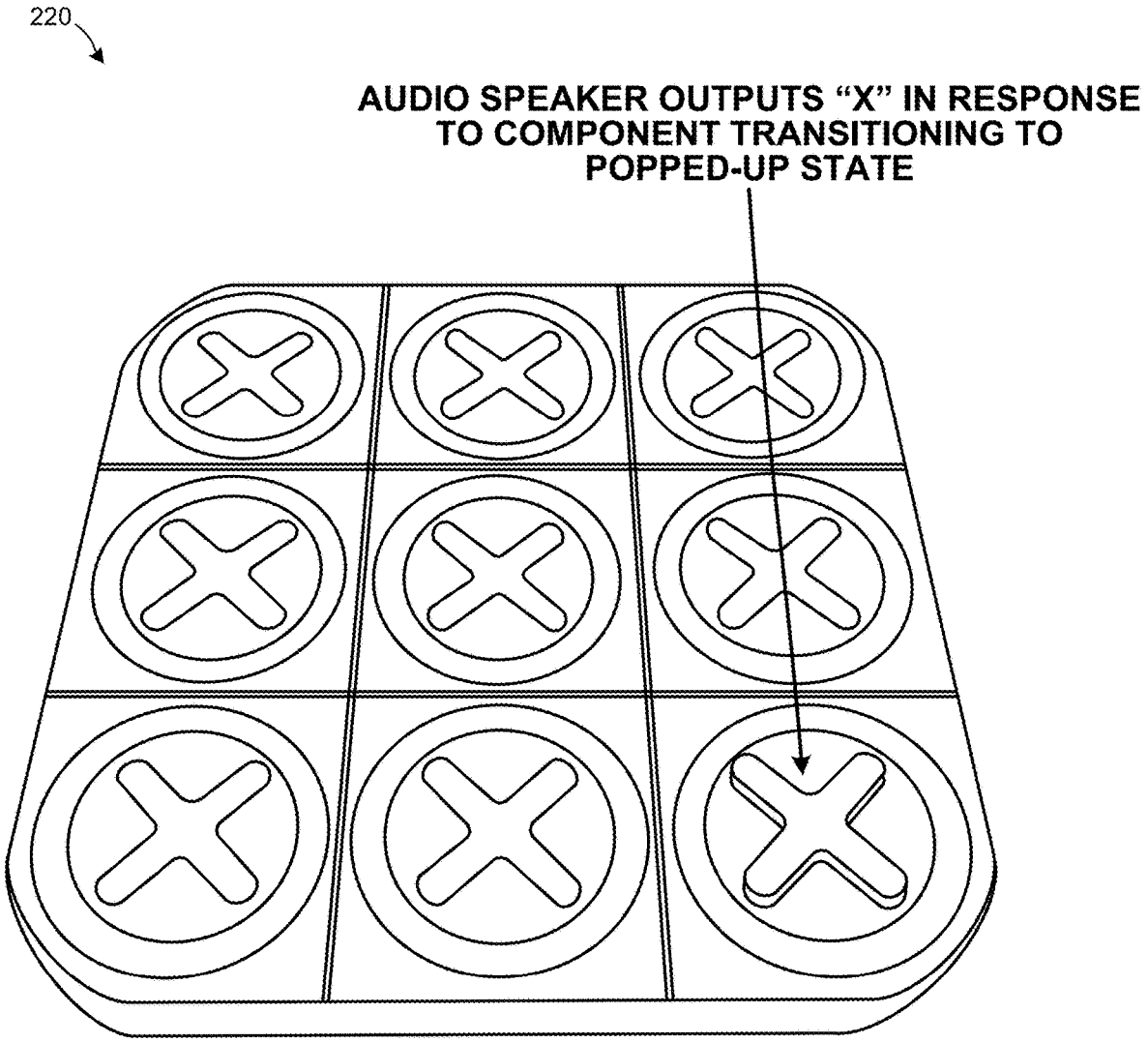
FIG. 12 is a diagram of another embodiment of a gaming device 220.

FIG. 12 is a diagram of another embodiment of a gaming device 220. Gaming device 220 is substantially similar to the gaming device 10 of FIG. 1. The gaming device 220 includes an auditory indicator that emits sound indicating when a component is pressed. For example, circuitry, including an audio speaker, is included that detects when a component is pressed and outputs sound indicating the type of component pressed.

Figure 13:
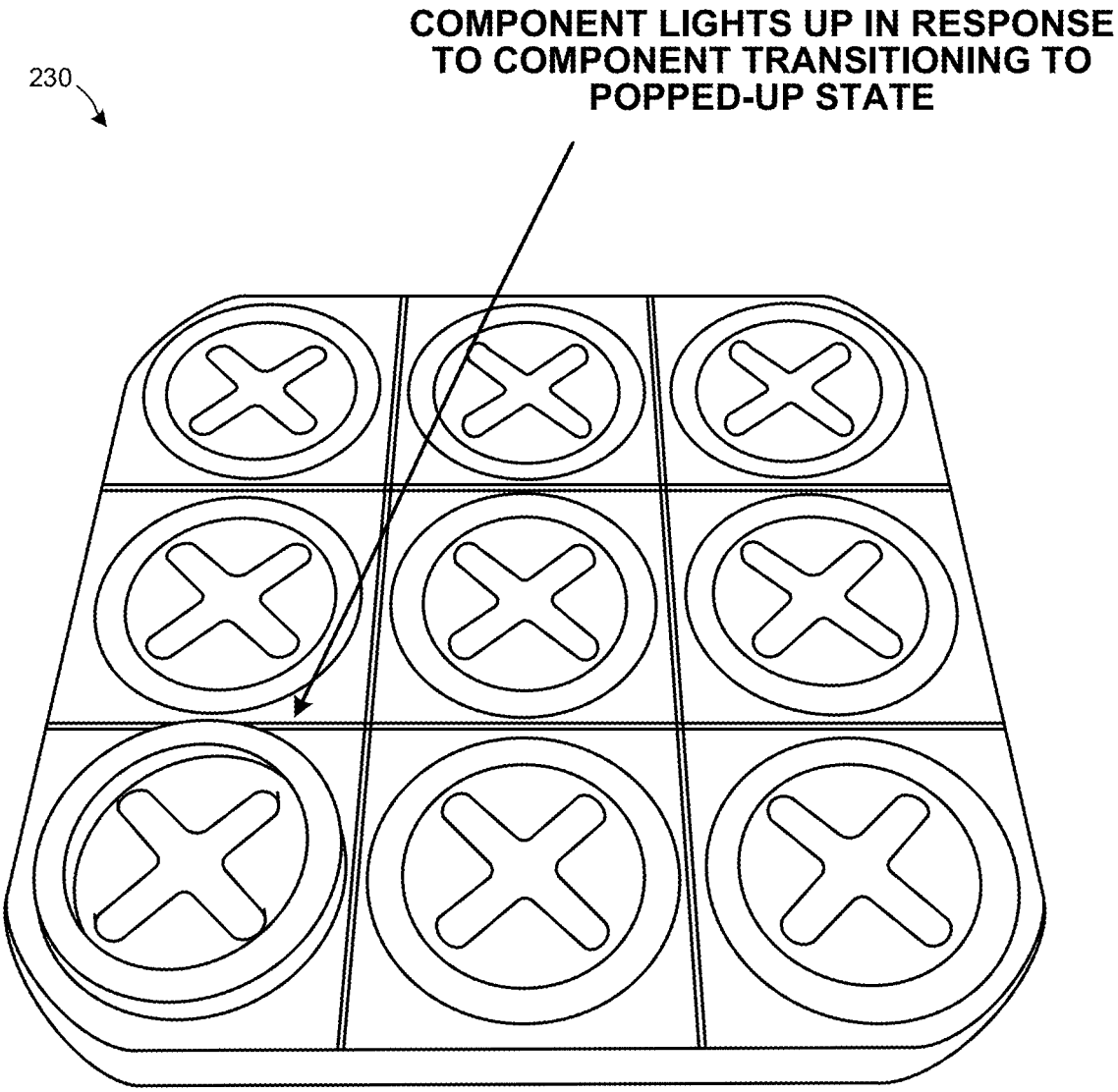
FIG. 13 is a diagram of another embodiment of a gaming device 230.

FIG. 13 is a diagram of another embodiment of a gaming device 230. Gaming device 230 is substantially similar to the gaming device 10 of FIG. 1. The gaming device 230 includes a visual indicator that emits light indicating when a component is pressed. For example, circuitry, including a light source, is included that detects when a component is pressed and causes the component to light up when pressed.

Figure 14:
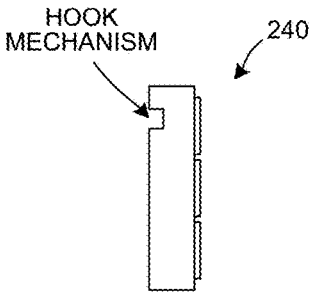
FIG. 14 is a diagram of another embodiment of a gaming device 240.

FIG. 14 is a diagram of another embodiment of a gaming device 240. Gaming device 240 is substantially similar to the gaming device 10 of FIG. 1. The gaming device 240 includes a hook mechanism that allows the gaming device 240 to be attached to a surface, such as a wall. In this example, the hook mechanism is an indentation that is attachable to another attachment mechanism.

Figure 15:
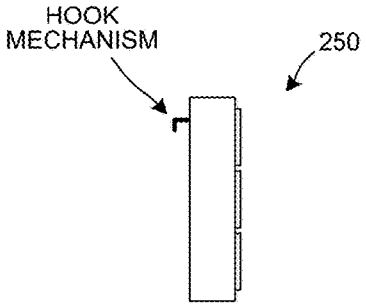
FIG. 15 is a diagram of another embodiment of a gaming device 250.

FIG. 15 is a diagram of another embodiment of a gaming device 250. Gaming device 250 is substantially similar to the gaming device 10 of FIG. 1. The gaming device 250 includes a hook mechanism that allows the gaming device 250 to be attached to a surface, such as a wall. In this example, the hook mechanism is a protrusion that is attachable to another attachment mechanism.

Figure 16:
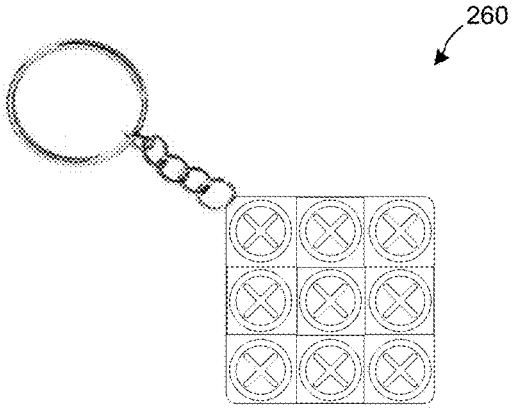
FIG. 16 is a diagram of another embodiment of a gaming device 260.

FIG. 16 is a diagram of another embodiment of a gaming device 260. In one example, the gaming device 260 is a miniature version of the gaming device 10 of FIG. 1. In another example, the gaming device 260 is a miniature version of the gaming device 10 of FIG. 1 but does not include any operable or press-able components.

Although certain specific exemplary embodiments are described above in order to illustrate the invention, the invention is not limited to the specific embodiments. In the gaming device of FIG. 1, nine gaming areas are shown. In other embodiment, more or less gaming areas are included and more or less components are employed depending on game type. Tic-tac-toe is illustrated, however, it is understood that other games may be designed employing these techniques by providing a base member with appropriately shaped press-able components arranged in a proper fashion for the particular game. Accordingly, various modifications, adaptations, and combinations of various features of the described embodiments can be practiced without departing from the scope of the invention as set forth in the claims.

What is claimed is:

1. A gaming device comprising:

a base member, wherein the base member has an upper surface and a bottom surface; and a plurality of components, wherein a first pair of components is disposed within a first gaming area of the base member, wherein a second pair of components is disposed within a second gaming area of the base member, wherein each of the components is in one of two selectable states, wherein each of the components is attached to the base member in both of the selectable states, wherein when a component is in one of the two selectable states, the component extends above the upper surface, and wherein at least one component at least partially surrounds another component.

2. The gaming device of claim 1, wherein when a component is in the first of the two selectable states, a part of the component is disposed below the upper surface of the base member, and wherein when the component is in the second of the two selectable states, the part of the component is disposed above the upper surface of the base member.

3. The gaming device of claim 2, wherein the first of the two selectable states is a pressed-down state, and wherein the second of the two selectable states is a popped-up state.

4. The gaming device of claim 1, wherein each of the components has one of two gaming type characteristics, wherein each gaming area has at least one component having one of the two gaming type characteristics and at least one component having the other of the two gaming type characteristics.

5. The gaming device of claim 4, wherein a first of the two gaming type characteristics indicates components corresponding to a first player, and wherein a second of the two gaming type characteristics indicates components corresponding to a second player.

6. The gaming device of claim 4, wherein the gaming type characteristics are shapes, wherein a first of the two gaming type characteristics is a circular shape, and wherein a second of the two gaming type characteristics is a cross shape.

7. The gaming device of claim 1, wherein each of the components is either surrounded by another component or surrounds another component.

8. The gaming device of claim 1, wherein each of the components is toggled between the two selectable states in response to being pressed down towards the bottom surface of the base member.

9. The gaming device of claim 1, wherein the gaming device does not include any electrical components, and wherein the two selectable states are toggled using an entirely mechanical mechanism.

10. The gaming device of claim 1, wherein the mechanical mechanism is a spring-loaded retractable click mechanism.

11. The gaming device of claim 1, wherein the gaming device includes a battery that supplies an electrical component, wherein the electrical component is activated in response to one of the components being toggled between the two selectable states, and wherein the electrical component is taken from the group consisting of: a light source that is activated when the component toggles between the selectable states, and an audio speaker that indicates a state of one of the components when toggled between the selectable states.

12. The gaming device of claim 1, wherein at least one of the components includes an amount of glow-in-the-dark material that emits light visible in a dark environment.

13. The gaming device of claim 1, wherein the gaming device does not include any removable or detachable pieces, and wherein a game is played on the gaming device without any additional components other than those disposed on the base member.

14. The gaming device of claim 1, wherein the gaming device includes a hook attached to the base member, and wherein the gaming device is attachable to another surface using the hook.

15. A method comprising:

(a) forming a gaming device having a base member and a plurality of components, wherein the base member has an upper surface and a bottom surface, wherein a first pair of components is disposed within a first gaming area of the base member, wherein a second pair of components is disposed within a second gaming area of the base member, wherein each of the components is in one of two selectable states, wherein the components remain fixed to the base member in both of the two selectable states, wherein when a component is in one of the two selectable states, then part of the component is above the upper surface of the base member, and wherein at least one component is at least partially surrounded by another component.

16. The method of claim 15, further comprising:

(b) packaging the gaming device formed in (a) with an amount of packaging material.

17. The method of claim 16, further comprising:

(c) instructing a first user to play a game using the gaming device, wherein each of the components is either a first type or a second type, wherein components of the first type are associated with the first user during the game, and wherein components of the second type are associated with the second user during the game.

18. An apparatus comprising:

a base member having a plurality of components, wherein a first pair of components is disposed within a first gaming area of the base member, wherein a second pair of components is disposed within a second gaming area of the base member, wherein at least one component at least partially surrounds another component, wherein each of the components is in one of two selectable states, and wherein each of the components is attached to the base member in both of the selectable states; and means for toggling components between the two selectable states such that when a component is in the first of the two selectable states, a part of the component is disposed below an upper surface of the base member, and wherein when the component is in the second of the two selectable states, the part of the component is disposed above the upper surface of the base member.

19. The apparatus of claim 18, wherein the means is a spring-loaded retractable click mechanism.

20. The apparatus of claim 19, wherein each of the components is either surrounded by another component or surrounds another component, wherein each of the components is toggled between the two selectable states in response to being pressed down towards the bottom surface of the base member, and wherein the gaming device does not include any removable or detachable pieces.

* * * * *